US006487378B1

(12) United States Patent
Ono

(10) Patent No.: US 6,487,378 B1
(45) Date of Patent: Nov. 26, 2002

(54) ELECTROPHOTOGRAPHIC APPARATUS, MAIN UNIT AND SUB-UNIT, BOTH FOR USE IN THE ELECTROPHOTOGRAPHIC APPARATUS, AND METHOD OF IDENTIFYING THE SUB-UNIT

(75) Inventor: Shunichi Ono, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/981,208

(22) Filed: Oct. 17, 2001

(51) Int. Cl.[7] ..... G03G 15/00; G03G 21/16
(52) U.S. Cl. ..... 399/12; 340/679
(58) Field of Search ..... 399/12, 13, 25; 340/572.1, 679; 338/15

(56) References Cited

U.S. PATENT DOCUMENTS 5,758,224 A * 5/1998 Binder et al. ..... 399/25
6,104,888 A * 8/2000 Kobayashi ..... 399/12
6,324,350 B1 * 11/2001 Ito et al. ..... 399/12

FOREIGN PATENT DOCUMENTS

JP 6-118736 A 4/1994
JP 2000-29369 A 1/2000

* cited by examiner

*Primary Examiner*—Joan Pendegrass
(74) *Attorney, Agent, or Firm*—Frishauf, Holtz, Goodman & Chick, P.C.

(57) ABSTRACT

A sub-unit is fitted with a resistor film which is changed in conductivity when exposed. This resistor film is exposed by, for-example, a laser scanner 3 when the sub-unit enters an operative state. When the sub-unit is attached to a main unit, the main unit detects a conductivity of the resistor film fitted to this sub-unit and then decides whether it is unused on the basis of the thus detected conductivity.

14 Claims, 11 Drawing Sheets

ELECTROPHOTOGRAPHIC APPARATUS, MAIN UNIT AND SUB-UNIT, BOTH FOR USE IN THE ELECTROPHOTOGRAPHIC APPARATUS, AND METHOD OF IDENTIFYING THE SUB-UNIT

BACKGROUND OF THE INVENTION

1. Field of the Invention

The present invention relates to an electrophotographic apparatus in which consumables are collected into a sub-unit so that it may be replaceable, a main unit for the electrophotographic apparatus and a sub-unit thereof, and a method for identifying the sub-unit.

2. Description of the Related Art

Electrophotographic apparatuses such as a laser printer are well known. The electrophotographic apparatus includes many consumables such as a photosensitive drum and a developing device. For easy maintenance thereof by a user, the consumables are collected into a unit so that it may easily be replaced. That is, the electrophotographic apparatus is divided into a main unit and a sub-unit into which the consumables are collected so that the sub-unit may be replaced for easy replacement of the consumables.

The sub-unit expires in service life as it is used for a certain period and then cannot achieve the expected performance. The main unit, monitors the quantity of the sub-unit consumed to prompt the user to replace it before its service life expires. The consumed quantity of, for example, the sub-unit is monitored on the basis of the number of sheets of images formed using this sub-unit. That is, the consumed quantity of the sub-unit is monitored by counting the total number of printed sheets from the timing the sub-unit is attached. To correctly monitor the consumed quantity of the sub-unit, therefore, it is necessary that the unused sub-unit is attached. For this purpose, it has conventionally been decided whether the attached sub-unit is not used yet, when the sub-unit is attached.

As techniques for deciding whether or not the attached sub-unit is unused, there are known Jpn. Pat. Appln. KOKAI Publication No. 6-118736 and Jpn. Pat. Appln. KOKAI Publication No. 2000-29369.

According to the technology disclosed in Jpn. Pat. Appln. KOKAI Publication No. 6-118736, the sub-unit is fitted with an electronic element such as a fuse so that whether the sub-unit is unused is decided on based on conduction/nonconduction of the electronic element. That is, first, each sub-unit is fitted with an electronic element capable of continuity, after the sub-unit is attached to the main unit, the electronic element is destroyed to provide discontinuity. By this, it is possible to decide that the sub-unit is unused if the electronic element is continuous. If it is not continuous, on the other hand, the sub-unit is decided to be already used.

According to the technology disclosed in Jpn. Pat. Appln. KOKAI Publication No. 2000-29369, each sub-unit is fitted with a barcode label, whereby whether the sub-unit is unused is decided on based on the information carried by this barcode label. That is, the sub-unit is decided to be unused if the information of the bar code label read out from the sub-unit differs from that read out previously and, otherwise, it is decided to be used already.

There are known other similar examples of mounting a non-volatile memory for permitting the sub-unit to have identification information.

By the technology disclosed in Jpn. Pat. Appln. KOKAI Publication No. 6-118736, however, the electronic element may not securely be destroyed depending on characteristics or fluctuations of the electronic element. In such a case, this electronic element is, when the sub-unit carrying it is attached to the main unit again, continuous electrically, so that the main unit may mistakenly decide that the sub-unit is unused.

By the technology disclosed in Jpn. Pat. Appln. KOKAI Publication No. 2000-29369 or by a memory mounting technology, on the other hand, the relevant configuration and processing becomes complicated. Moreover, the number of the interface signals transferred between the main unit and the sub-unit is increased, thus increasing the costs and grading the reliability problematically.

BRIEF SUMMARY OF THE INVENTION

It is an object of the invention to make it possible to securely decide whether a sub-unit is unused with a simple configuration.

One aspect of this invention provides such an electrophotographic apparatus as follows.

An electrophotographic apparatus, having a main unit and a sub-unit which is attachable, in such a way that it may be detached, to the main unit arbitrarily, for using the sub-unit in the main unit to thereby form an image, comprising: a resistive element which is fitted to the sub-unit and which is made of such a material that is changed in conductivity when exposed; an exposure section configured to expose the resistive element when the sub-unit attached to the main unit enters a predetermined operative state; a detection section configured to detect a conductivity of the resistive element fitted to the sub-unit attached to the main unit; and an identification section, provided on the main unit, configured to decide whether, as the attachment of the sub-unit is made, the attached sub-unit is unused on the basis of the conductivity detected by the detection section.

A main unit which, when a sub-unit fitted with a resistive element made of such a material that is changed in conductivity when exposed is arbitrarily attached thereto, constitutes an electrophotographic apparatus together with the sub-unit, comprising: a detection section configured to detect a conductivity of the resistive element fitted to the sub-unit attached; and an identification section configured to decide whether, as the attachment of the sub-unit is made, the attached sub-unit is unused on the basis of a conductivity detected by the detection section.

A sub-unit which is arbitrarily attached to a main unit and which constitutes an electrophotographic apparatus together with the main unit in order to enable image formation by the main unit, the sub-unit including a resistive element made of a material which is changed in conductivity when exposed.

An identification method for performing the identification of a sub-unit fitted with a resistive element made of a material which is changed in conductivity when exposed, by a main unit which forms an image by utilizing the sub-unit and also which constitutes an electrophotographic apparatus together with the sub-unit when the sub-unit is arbitrarily attached thereto, the method comprising: detecting a conductivity of the resistive element fitted to the sub-unit attached; and deciding, as the attachment of the sub-unit is made, whether the attached sub-unit is unused on the basis of the detected conductivity.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

The following will describe embodiments of the present invention with reference to the drawings.

First Embodiment

Figure 1:
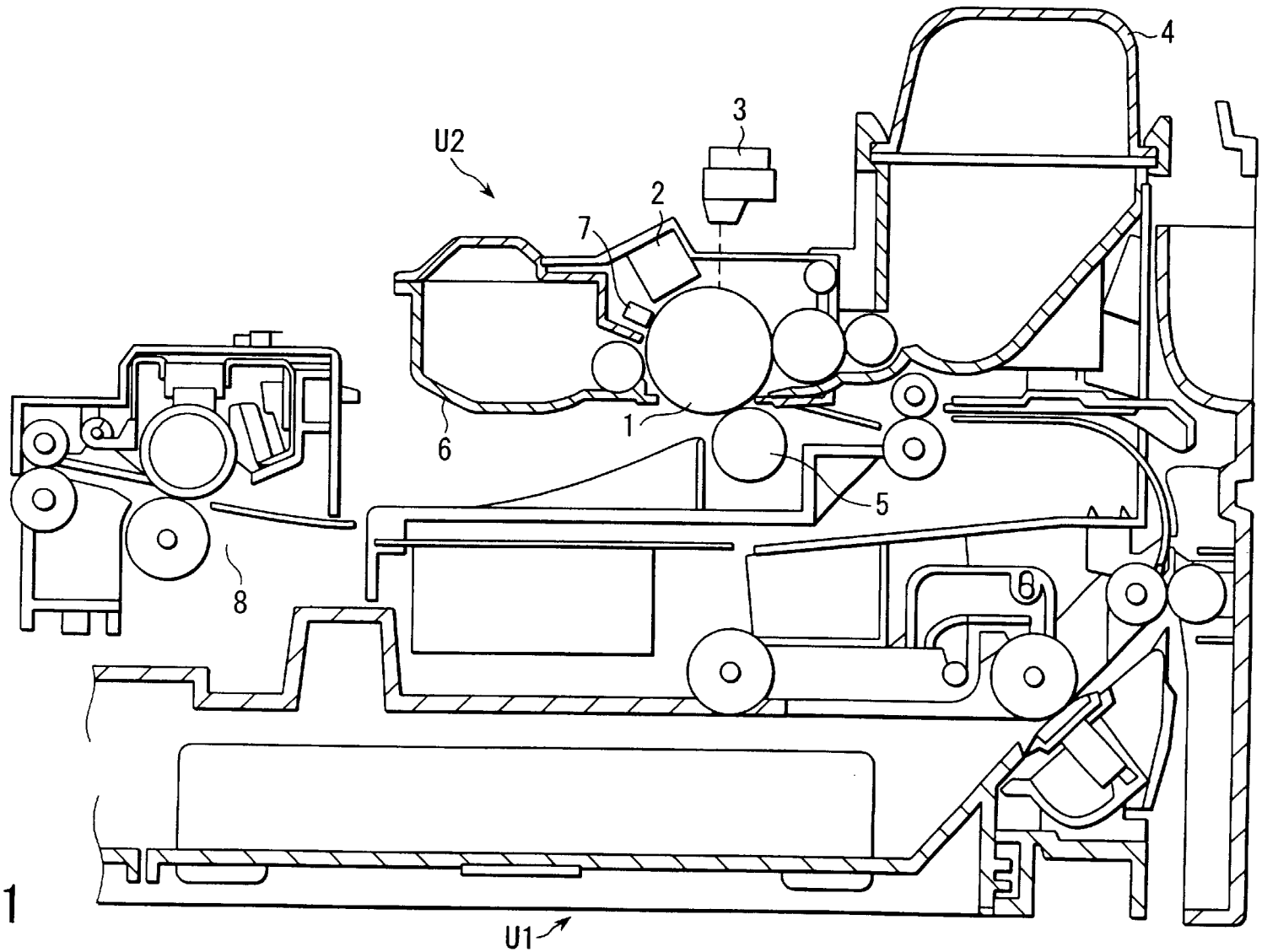
FIG. 1 is a partial cutaway view for showing a main part of an electrophotographic apparatus according to a first embodiment of the present invention.

FIG. 1 is a partial cutaway view for showing a main part of an electrophotographic apparatus according to a first embodiment of the present invention.

This electrophotographic apparatus has a main unit U1 and a sub-unit U2. The sub-unit U2 collects therein consumables of the components of the electrophotographic apparatus, thus forming a unit. The sub-unit U2 is detachably attachable to the main unit U1 in a way that allows it to be detached.

That is, the electrophotographic apparatus has a photosensitive drum 1, a charging device 2, a laser scanner 3, a developing device 4, a transferring device 5, a cleaner 6, a discharging lamp 7, and a fixing device 8, to perform electrophotographic processes of these component, the photosensitive drum 1, the charging device 2, developing device 4, transferring device 5, cleaner 6 and discharging lamp 7 are combined, forming a unit, or the sub-unit U2.

Figure 2A:
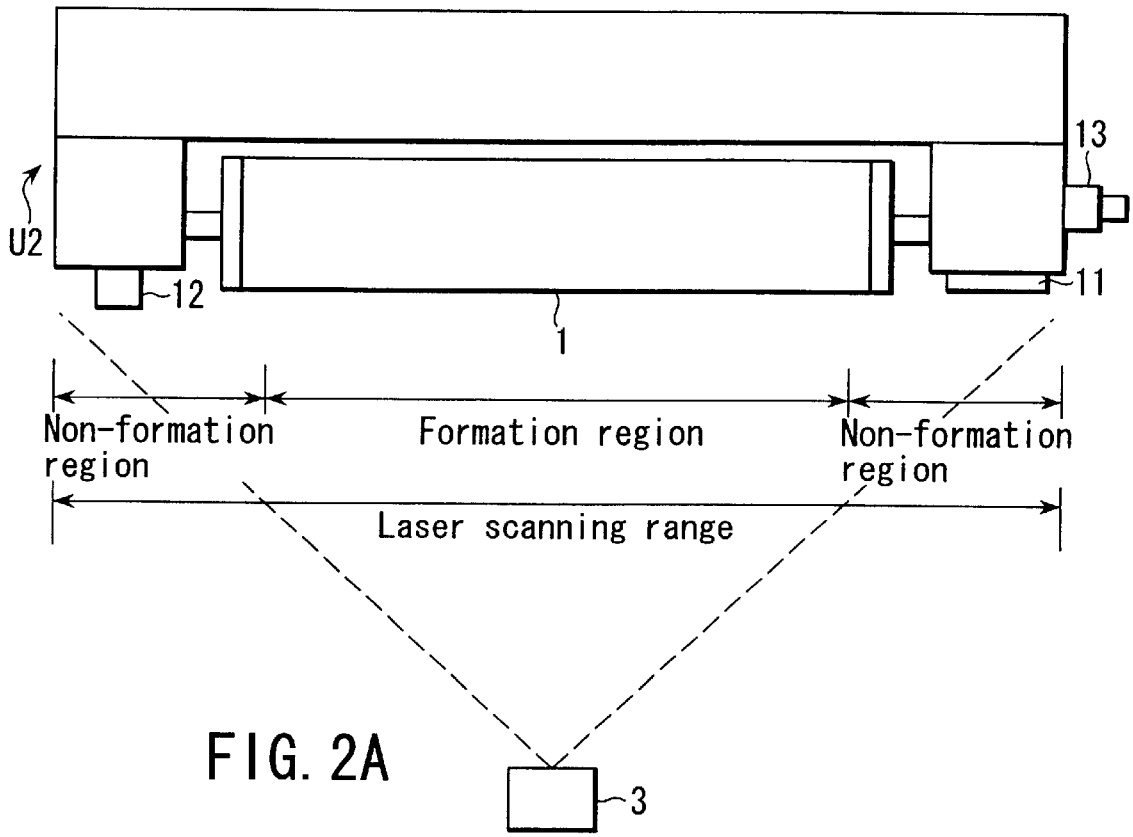
FIGS. 2A and 2B are plan views for showing a construction for sub-unit identification in the electrophotographic apparatus of the first embodiment of the present invention.
Figure 2B:
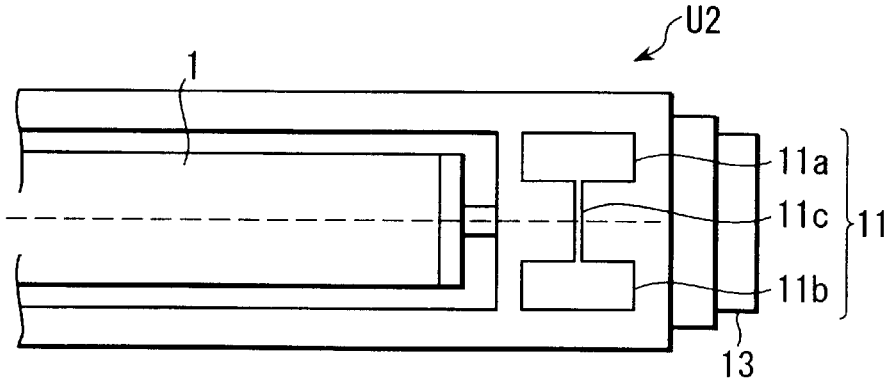

FIGS. 2A and 2B are plan views for showing a construction for identification of the sub-unit U2. Incidentally, FIG. 2B shows the contents of FIG. 2A as viewed from the lower side. The same elements in FIGS. 2A and 2B are indicated by the same reference numerals.

As shown in FIGS. 2A and 2B, the sub-unit U2 is fitted with a resistor film 11. The resistor film 11 is formed by applying on the surface of a member supporting the photosensitive drum 1 such a conductive material that changes in conductivity when exposed. The conductive material may be a photo-conductive material having a photo-electric effect and employed on, for example, the surface of a photosensitive substance, or may be a material formed by mixing a photo-polymer and carbon molecules. The resistor film 11 is planar-shaped and comprised of two terminal regions 11*a* and 11*b* and an exposure region 11*c* interconnecting these two terminal regions. The resistor film 11 is disposed such that the exposure region 11*c* may be located at a position where a laser beam emitted from the laser scanner 3 reaches and also in a region where no image is formed. A broken line in FIG. 2A indicates a trace of the laser beam at both ends of a scanning range of the laser beam. A broken line in FIG. 2B, on the other hand, indicates a trace of the laser beam in the sub-unit U2.

Incidentally, FIGS. 2A and 2B show also a beam detector 12 and a connector 13. The beam detector 12 detects a laser beam for detecting a timing at which the laser beam starts to scan. The connector 13 is used to electrically connect with the main unit U1.

Figure 3:
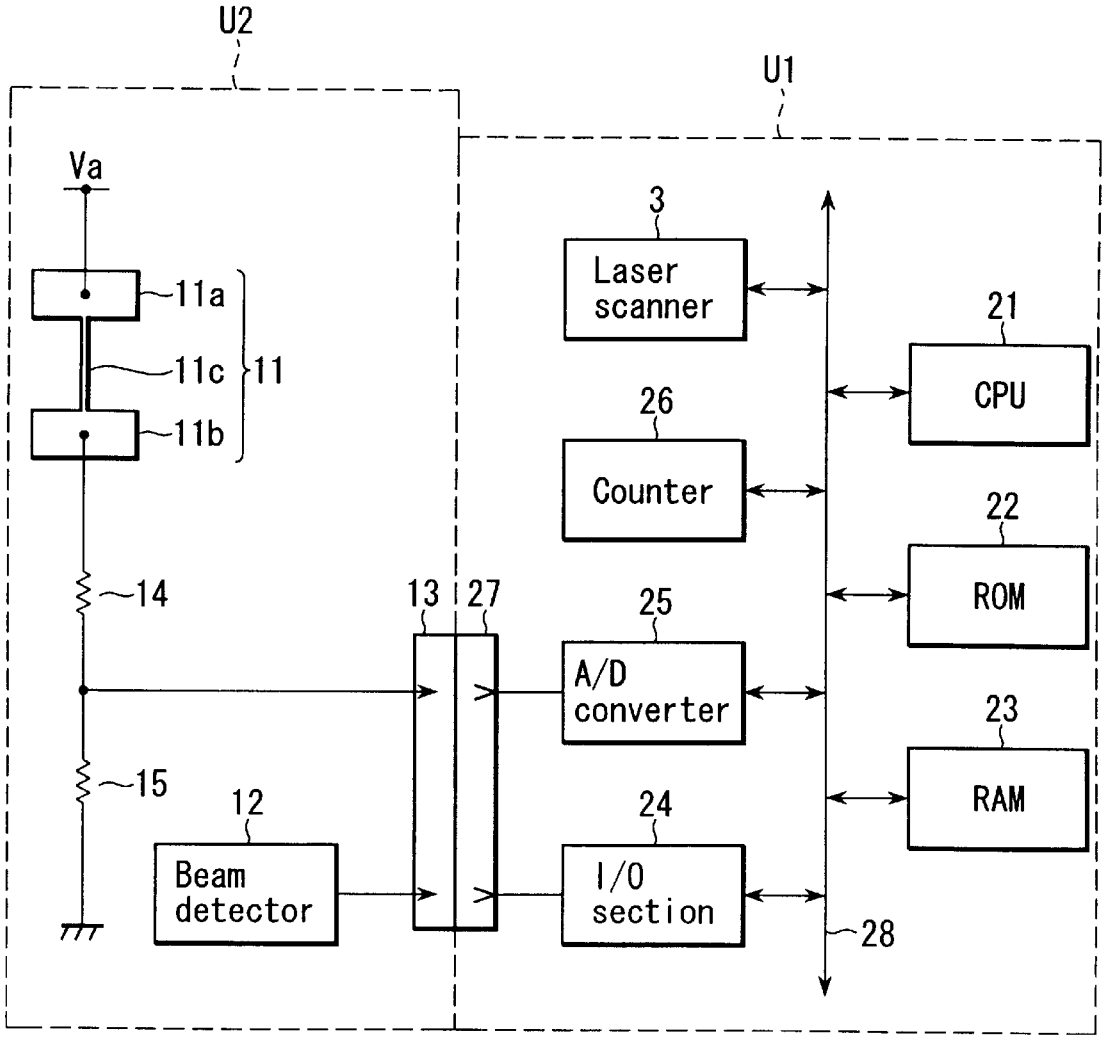
FIG. 3 is an illustration for showing an electric circuit for sub-unit identification in the electro-photographic apparatus of the first embodiment of the present invention.

FIG. 3 shows a configuration of an electric circuit for identification of the sub-unit U2. The same elements in FIG. 1 and FIGS. 2A and 2B are indicated by the same reference numerals.

As shown in FIG. 3, the sub-unit U2 has resistors 14 and 15, as well as the resistor film 11, beam detector 12 and connector 13. The main unit U1 has, besides the laser scanner 3, a CPU 21, a ROM 22, a RAM 23, an I/O section 24, an A/D converter 25, a counter 26 and a connector 27. A bus connects the laser scanner 3, CPU 21, ROM 22, RAM 23, I/O section 24, A/D converter 25 and counter 26.

An electric circuit on the side of the main unit U1 and that on the side of the sub-unit U2 are interconnected by coupling the connectors 13 and 27.

In the sub-unit U2, the resistor film 11 has its terminal region 11*a* connected with a voltage-Va power supply line. The resistor film 11 has its terminal region 11*b* connected with one end of the resistor 14. The other end of the resistor 14 is connected with one end of the resistor 15. The other end of the resistor 15 is grounded. An interconnection of the resistors 14 and 15 is connected via the connectors 13 and 27 to the A/D converter 25.

The beam detector 12 is connected via the connectors 13 and 27 to the I/O section 24. The beam detector 12 outputs to the I/O section 24 such a detection signal that indicates incidence/non-incidence of a laser beam.

The CPU 21 executes software processing based on an operational program stored in the ROM 22 thereby to control the various units for realizing the operations as the electrophotographic apparatus.

The ROM 22 stores the control programs etc. for the CPU 21.

The RAM 23 stores various kinds of information necessary for the CPU 21 to execute various processes.

The I/O section 24 carries out I/O processing of various signals through the connectors 13 and 27.

The A/D converter 25 converts a voltage applied through the connectors 13 and 27 into a digital voltage and posts its value to the CPU 21.

The counter 26 counts the number of sheets of images formed. The count of the counter 26 is reset by the CPU 21.

The CPU 21 executes a software processing based on the operation programs stored in the ROM 22. The CPU 21 therefore functions not only as a control section of the known type for use in electro-photographic apparatuses, but also as an identification section and an exposure control section. The identification section determines whether the sub-unit U2 has not been used, from a voltage applied from the A/D converter 25. If the identification section determines that the sub-unit U2 has not been used, the exposure control section operates the laser scanner 3 to expose the resistor film 11 to light when sub-unit U2 enters an operative state.

Next the following will detail the above-mentioned operations of the electrophotographic apparatus. Note that the operations related to image formation are conventionally the same as those with the same type of apparatuses and therefore omitted in explanation. Instead, the operations of identifying the sub-unit U2 are detailed here.

First, in the sub-unit U2, the resistor film 11 and the resistors 14 and 15 are combined to make up a voltage divider circuit for dividing the voltage Va by a ratio of a combined resistance of the resistor film 11 and the resistor 14 and a resistance of the resistor 15. Then, a signal having a voltage obtained by this voltage divider circuit (hereinafter called the decision signal) is provided to the A/D converter 25. The resistors 14 and 15 have fixed resistance values. Therefore, with the changing resistance of the resistor film 11, the voltage division ratio changes and hence the voltage of the decision signal. Specifically, the resistor film 11 is not exposed yet at the time of shipment of the sub-unit U2 and so has a certain value of conductivity. When the resistor film 11 is exposed to light, however, it has its conductivity decreased from the conductivity it has before exposed to light. This causes the decision signal to have a higher voltage when the resistor film 11 is unexposed than when it is exposed.

Figure 4:
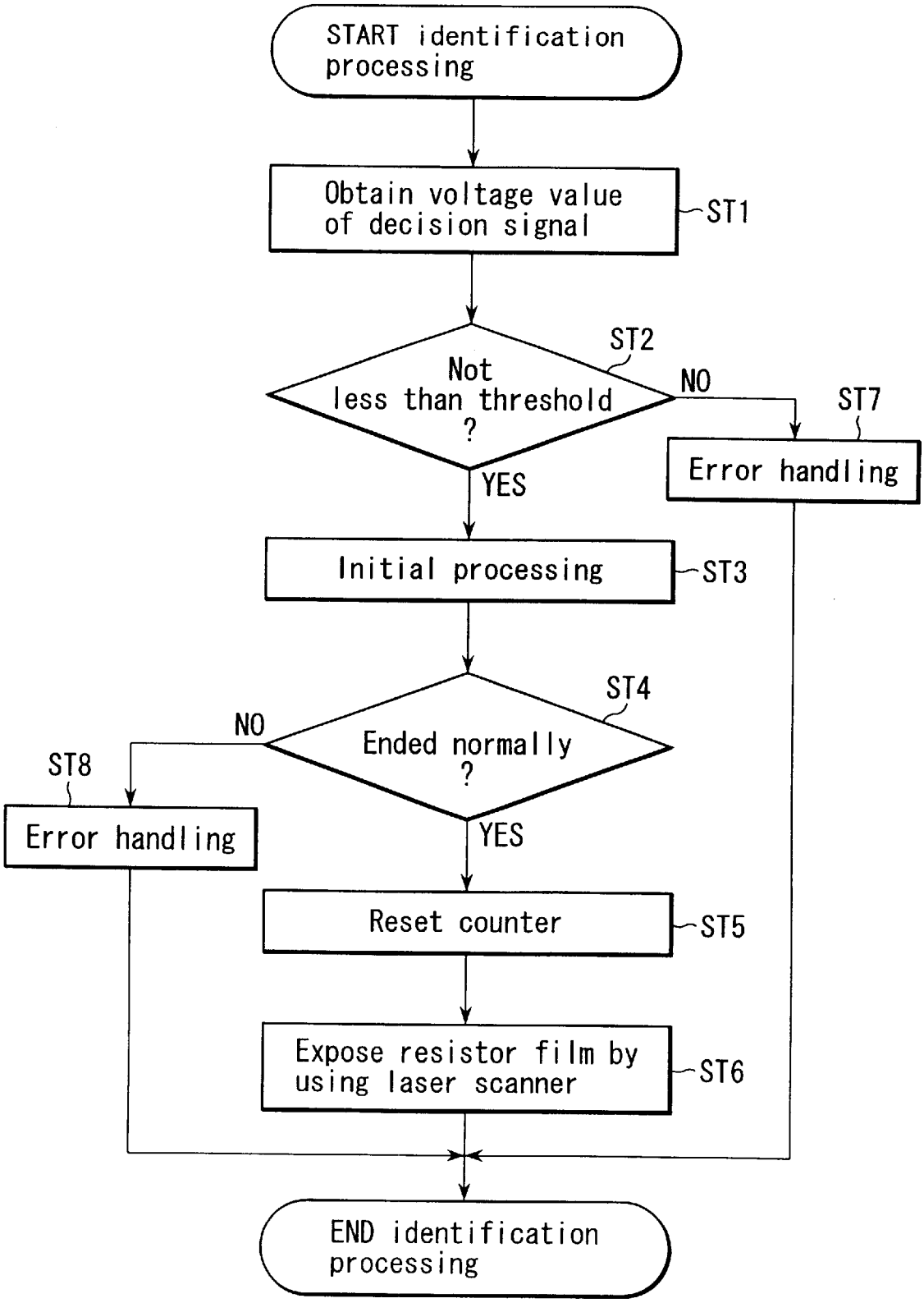
FIG. 4 is a flowchart for showing identification processing according to the first embodiment of the present invention.

When the sub-unit U2 is attached to the main unit U1, the CPU 21 then executes such identification processing as shown in FIG. 4.

In this identification processing, first the CPU 21 obtains a voltage value of the decision signal from the A/D converter 25 (step ST1) to then confirm whether the voltage value is not less than a predetermined threshold value (step ST2). The threshold value is beforehand set to an intermediate value between a voltage value of the decision signal when the resistor film 11 is unexposed and that of the decision signal when it is exposed.

If has the voltage value of the decision signal is not less than the threshold value, the resistor film 11 of the sub-unit U2 as attached is decided to be in the unexposed state. That is, the attached sub-unit U2 is decided to be unused. When thus having confirmed a voltage value of the decision signal being not less than the threshold value at step ST2, the CPU 21 executes initial processing (step ST3). This initial processing serves to test the operations of the various sections. Upon completion of the initial processing, the CPU 11 confirms whether the initial processing ended normally (step ST4).

In this embodiment, normal ending of the initial processing is to mark the start of use of the sub-unit U2. When thus having confirmed normal ending of the initial processing, the CPU 21 resets the counter 26 (step ST5). Then, the process starts monitoring the consumed quantity of the sub-unit U2 attached most recently. Then, the CPU 21 drives the laser scanner 3 to expose the resistor film 11 (step ST6). Upon completion of exposure of this resistor film 11, the CPU 21 ends the identification processing.

Next, control is described which is conducted on the laser scanner 3 for exposing the resistor film 11 at step ST6.

Figure 5:
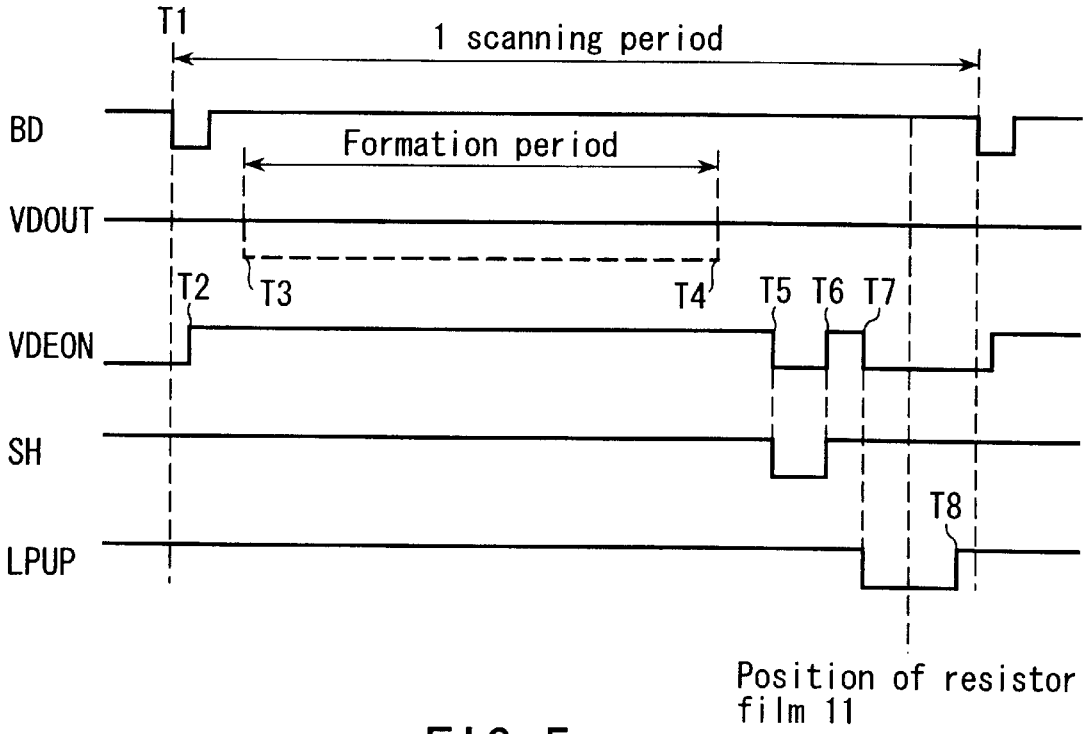
FIG. 5 is a timing chart of various signals for use in driving a laser scanner when a resistor film is exposed according to the first embodiment of the present invention.

FIG. 5 is a timing chart of various signals for driving the scanner 3 in order to expose the resistor film 11. Note here that the respective signals shown in FIG. 5 are all asserted at the LOW level.

The CPU 21 turns LOW the forced light-emission signal VDEON at a timing at which the laser scanner 3 scans near the beam detector 12, thus causing the laser scanner 3 to emit a laser beam. Then, the beam detector 12 detects it, causing the detection signal BD to turn LOW (timing T1). Using this timing as a reference, scanning is carried out once. When having confirmed that the detection signal BD turned LOW, the CPU 21 turns HIGH the forced light-emission signal VDEON (timing T2). Thereafter, exposure lasts for a predetermined formation period (from timing T3 to timing T4) starting from a timing at which such a predetermined time elapses that corresponds to a distance from the position of the beam detector 12 to an end of the image forming region. That is, during the formation period, in image formation, the print light-emission signal VDOUT is changed in level according to print data and so a laser beam is emitted. In exposure of the resistor film 11, however, the print light-emission signal VDOUT stays at the HIGH level.

When the formation period expires, to correct the laser beam, the forced light-emission signal VDEON and the sample hold signal SH are held at the LOW level simultaneously for a predetermined period (a period of from timing T5 to timing T6).

After completion of laser beam correction, the CPU 21 turns LOW the forced light-emission signal VDEON again at a timing before the position of scanning by the laser beam reaches the resistor film 11 (timing T7). This causes the laser beam to be applied to the resistor film 11 to thereby expose the resistor film 11. To ensure exposure of the resistor film 11, the CPU 21 enhances the intensity of the laser beam at a timing for exposing the resistor film 11. That is, the CPU 21 holds the output control signal LPUP at the LOW level for a period (from timing T7 to timing T8) when the position of scanning by the laser beam stays in the vicinity of the resistor film 11. The output control signal LPUP instructs a laser driver in the laser scanner 3 to enhance a light emission intensity. Thus, by enhancing the laser light intensity only at the timing for exposing the resistor film 11, it is possible to expose the resistor film 11 securely enough to change its conductivity sufficiently even if it is impossible with an ordinary laser beam intensity based on the sensitivity and the like of the photosensitive drum 1. Further, it is possible to avoid the photosensitive drum 1, the beam detector 12 and the like from being damaged.

Thus, when an unused sub-unit U2 enters an operative state, the resistor film 11 fitted thereto is exposed to have its conductivity decreased sufficiently. Therefore, if such a sub-unit U2 is once detached from the main unit U1 and then attached thereto again, the voltage value of the decision signal supplied to the main unit U1 is decreased below a value when an unused sub-unit U2 is attached.

That is, if the voltage of the decision signal is lower than the threshold value, the attached sub-unit U2 is decided to have been used. When having confirmed at step ST2 that the voltage value of the decision signal is less than the threshold value, the CPU 21 executes error handling to cope with attachment of a wrong sub-unit U2 (step ST7). Then, the identification processing is terminated. Note here that the contents of the error handling carried out at step ST7 may be arbitrary. The process performed at step ST7 may be, for example, notification of the attachment of a wrong sub-unit, to the user, inhibition of the image-forming process, or the like.

If having confirmed abnormal ending of the initial processing at step ST4, on the other hand, the CPU 21 executes error handling to cope with a failure of the initial processing (step ST8). The contents of the error handling may be arbitrary; for example, the user may be prompted to notify a maintenance person of that effect, may inhibit the execution of image formation, and may perform a similar process. In such a case, the CPU 21 skips steps 5 and 6, thus ending the identification processing. That is, a sub-unit U2 is not decided to be used if it is once attached to the main unit U1 but the initial processing failed.

In the first embodiment, the sub-unit U2 is provided with the resistor film 11, and whether the sub-unit U is unused is determined from a difference in the conductivity of the resistor film 11. The resistive film 11 is simple in structure, and its state can be determined by a very simple configuration.

The resistor film 11 is made of such a material that changes in conductivity when exposed, in such a configuration that the resistor film 11 is exposed when a sub-unit U2 is attached to the main unit U1 and enters an operative state. This makes it possible to securely change the state of the resistor film 11 and also to correctly decide whether the sub-unit U2 is unused.

Furthermore, since the first embodiment employs the laser scanner 3 as a light source for exposing the resistor film 11, no further light source needs to be provided, thus further simplifying the configuration. Moreover, since it is possible to arbitrarily control emission of a laser beam of the laser scanner 3 at the position of the resistor film 11, it is also possible to control the timing for exposing the resistor film 11 only by controlling the laser scanner 3.

Second Embodiment

Figure 6A:
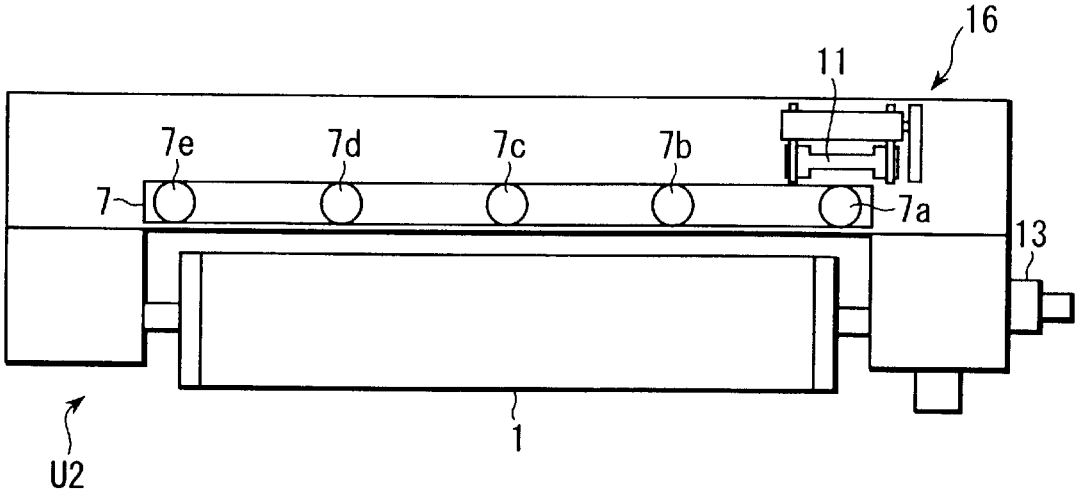
FIGS. 6A and 6B are plan views for showing a construction for use in sub-unit identification in an electrophotographic apparatus of a second embodiment of the present invention.
Figure 6B:
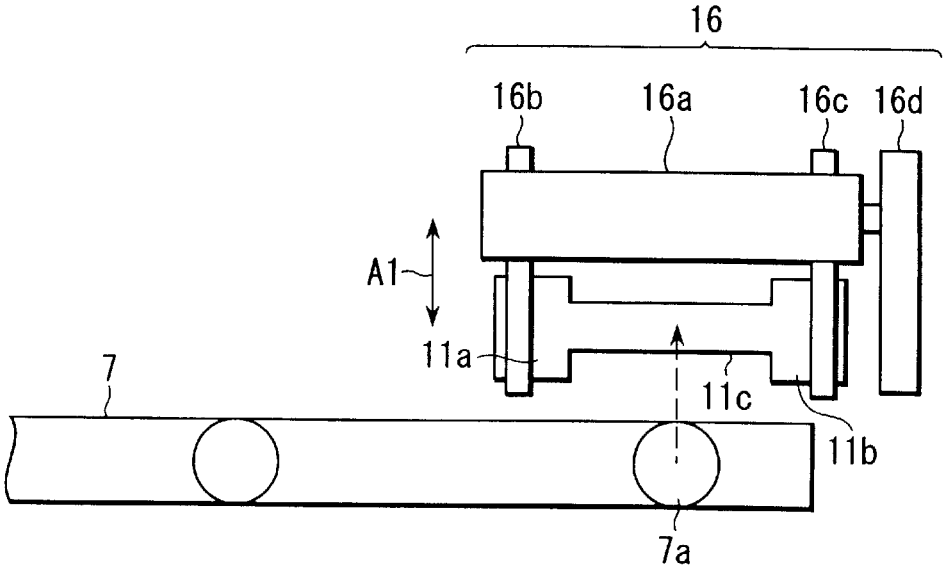

FIGS. 6A and 6B are plan views for showing a construction for identifying a sub-unit U2 in an electrophotographic apparatus according to the second embodiment of the present invention. FIG. 6B expands an important part of FIG. 6A. Note here that the basic configuration of the electrophotographic apparatus of the second embodiment is the same as that shown in FIG. 1. The same elements here are indicated by the same reference numerals in the preceding figures and so their explanation is omitted.

In the second embodiment, as shown in FIGS. 6A and 6B, the resistor film 11 is opposed to an LED 7*a* included in the discharging lamp 7 so that a light emitted from this LED 7*a* may be made incident upon a position in an exposure region 11*c*. Note here that the discharging lamp 7 is constituted arranging five LEDs 7*a*, 7*b*, 7*c*, 7*d*, and 7*e*. Note also that the second embodiment is provided with a mask mechanism 16 as shown in FIGS. 6A and 6B.

The mask mechanism 16 includes a mask plate 16*a*, rails 16*b* and 16*c*, and a motor 16*d*.

The mask plate 16*a* is made of a plate-shaped light-blocking material. It is supported by the rails 16*b* and 16*c* fixed to a frame of the sub-unit U2 in such a manner that it may slide in a direction indicated by an arrow A1 in FIG. 6B. The motor 16d moves the mask plate 16*a*.

Figure 7:
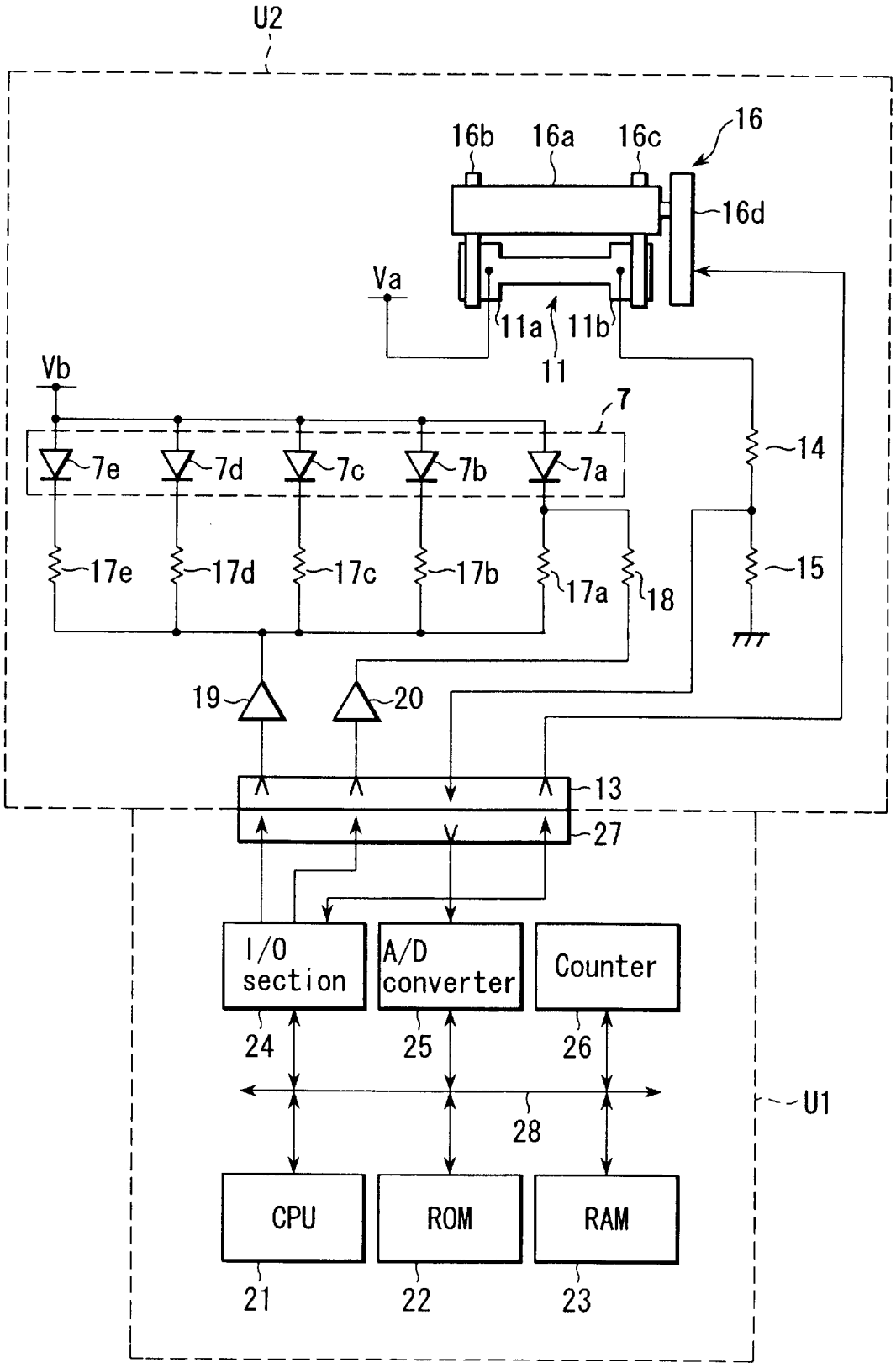
FIG. 7 is an illustration for showing a configuration of an electric circuit for sub-unit identification in the electrophotographic apparatus of the second embodiment of the present invention.

FIG. 7 is an illustration for showing a configuration of an electric circuit for identifying the sub-unit U2. The same elements here are indicated by the same reference numerals in the preceding figures and so their explanation is omitted.

As shown in FIG. 7, the sub-unit U2 has the discharging lamp 7, the resistor film 11, the connector 13, the resistors 14 and 15, the mask mechanism 16, resistors 17*a*, 17*b*, 17*c*, 17*d*, and 17*e*, a resistor 18, and drivers 19 and 20. The main unit U1 has the CPU 21, the ROM 22, the RAM 23, the I/O section 24, the A/D converter 25, the counter 26, and the connector 27. The CPU 21, the ROM 22, the RAM 23, the I/O section 24, the A/D converter 25, and the counter 26 are connected via a bus 28.

An electric circuit on the side of the main unit U1 and an electric circuit on the side of the sub-unit U2 are interconnected by coupling the connectors 13 and 27.

The anodes of the LED 7*a*–7*e* contained in the discharging lamp 7 are commonly connected to the voltage-Vb power supply line. The cathodes of the LEDs 7*a*–7*e* are connected with the corresponding one ends of the resistors 17*a*–17*e* respectively. The other ends of the resistors 17*a*–17*e* are commonly connected to the driver 19. The cathode of the LED 7*a* is connected with one end of the resistor 18. The other end of the resistor 18 is connected to the driver 20. The resistors 17*a*–17*e* have the same resistance value. The resistor 18 has a smaller resistance value than that of the resistors 17*a*–17*e*. The driver 19 turns ON/OFF the LEDs 7*a*–7*e* by supplying a current through the resistors 17*a*–17*e* respectively. The driver 20 turns ON/OFF the LED 7*a* by supplying a current through the resistor 18. The drivers 19 and 20 specifically carry out these turn-ON/OFF operations under the control of the CPU 21 through the connectors 13 and 17 and the I/O section 29.

The CPU 21 executes software processing based on the operational programs stored in the ROM 22 to thereby operate as an ordinary control section known in the electrophotographic apparatus as well as an identification section and an exposure control section. The identification section decides whether the sub-unit U2 is unused on the basis of a voltage value supplied from the A/D converter 25. The exposure control section, if the identification section decides an unused state of any sub-unit U2, operates the discharging lamp 7 and the mask mechanism 16 in order to expose the resistor film 11 when the sub-unit U2 has entered an operative state.

Next, the operations of the above-mentioned electrophotographic apparatus are described. The operations related to image formation, however, are the same as those with a prior art similar apparatus and so their explanation is omitted here. The following will detail those operations related to identification of the sub-unit U2.

The second embodiment is the same as the first embodiment in that the sub-unit U2 generates a decision signal having a voltage value which corresponds to whether the resistor film 11 is unexposed and then supplies it to the A/D converter 25.

Figure 8:
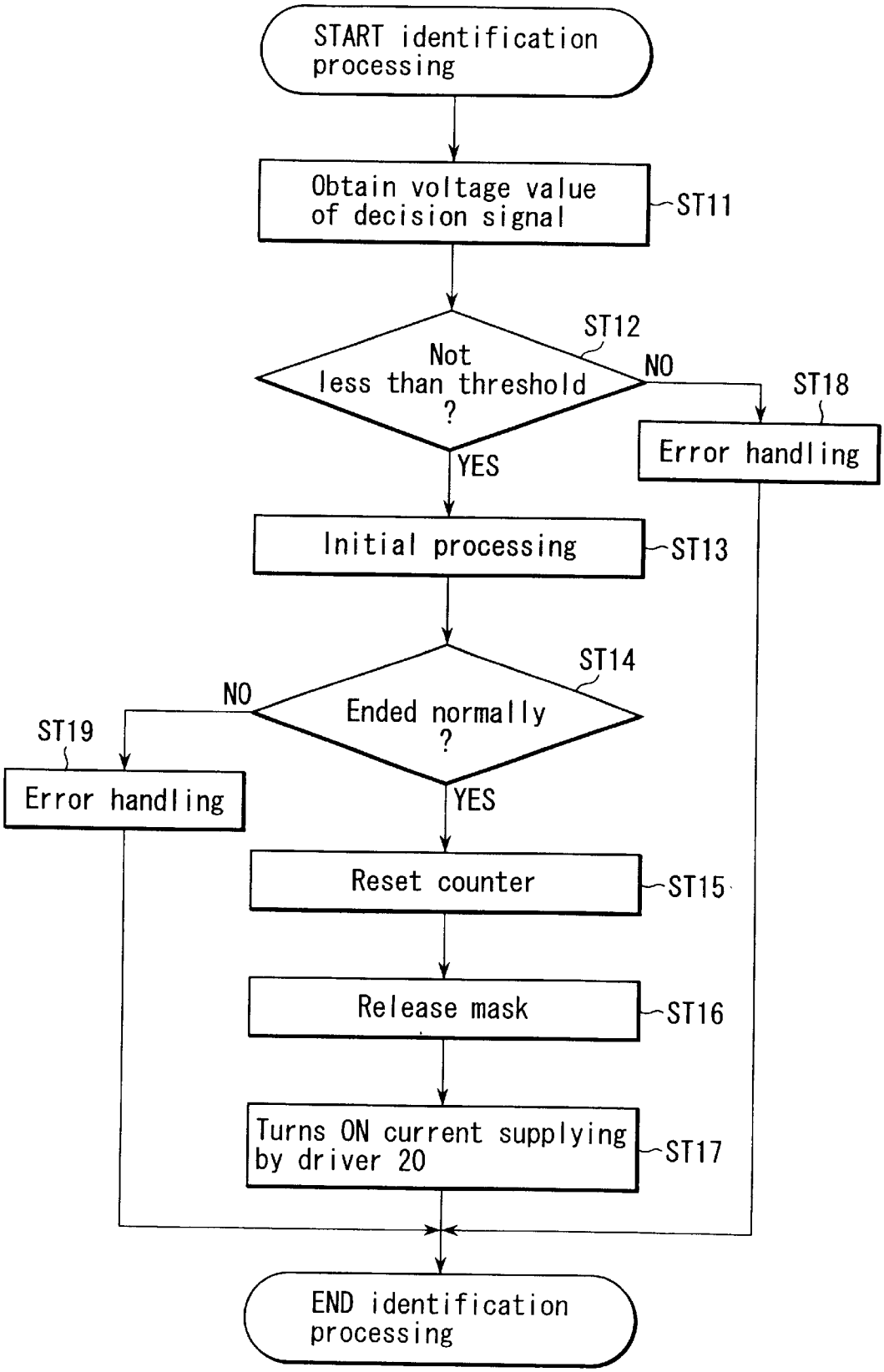
FIG. 8 is a flowchart for showing identification processing according to the second embodiment of the present invention.

When the sub-unit U2 changes in it state, from the one in which it is not attached to the main unit U1 to the sate in which it is attached thereto, the CPU 21 executes such an identification processing as is shown in FIG. 8.

In this identification processing, first the CPU 21 obtains a voltage value of the decision signal from the A/D converter 25 (step ST11) to then confirms whether the voltage value is not less than a predetermined threshold value (step ST12). This threshold value is beforehand set to an intermediate value between a voltage value of the decision signal when the resistor film 11 is unexposed and that of the decision signal when it is exposed.

If the voltage value of the decision signal is not less than the threshold value, the resistor film 11 of the sub-unit U2 as attached is decided to be in the unexposed state. That is, the attached sub-unit U2 is decided to be unused. When thus having confirmed a voltage value of the decision signal being not less than the threshold value at step ST12, the CPU 21 executes initial processing (step ST13). Incidentally, the initial processing is such processing as testing the operations of the respective sections. This processing involves emission of light from the discharging lamp 7. The discharging lamp 7 generally turns ON the LEDs 7*a*–7*e* simultaneously in order to evenly expose the photosensitive drum 1. That is, the driver 19 controls the supply of a current, causing emission of light. The discharging lamp 7 is also turned ON generally in the initial processing. Therefore, in the initial processing also, the LED 7*a* opposite the resistor film 11 is turned ON to emit light.

When a sub-unit U2 is shipped, the mask mechanism 16 is set thereon with its mask plate 16*a* as located above the resistor film 11. That is, in the initial state, the mask mechanism 16 is in such a state that the mask plate 16*a* is slid downward in FIG. 7 to be superposed on the resistor film 11. When the LED 7*a* emits light, therefore, the light thus emitted therefrom is blocked by the mask plate 16*a* and so little of it reaches the resistor film 11. That is, the resistor film 11 is not exposed at this timing.

Upon completion of the initial processing, the CPU 11 confirms whether the initial processing ended normally (step ST14).

In this embodiment, normal ending of the initial processing is to mark start of use of the sub-unit U2. When thus having confirmed normal ending of the initial processing, the CPU 21 resets the counter 26 (step ST15). Then, the process starts monitoring the consumed quantity of the sub-unit U2 attached most recently.

Then, the CPU 21 drives the motor 16*d* to change the mask plate 16*a* into such a state as shown in FIG. 7 (step ST16). Then, the CPU 21 causes the driver 20 to turn ON the discharging lamp 7 by supplying a current thereto, whereby the lamp 7 emits light (step ST17). Since the driver 20 turns ON only the LED 7*a*, only the LED 7*a* emits light in effect. The driver 20 supplies a current to the LED 7*a* through the register 18 that has a lower resistance than the resistor 17*a* that is generally used. Through the LED 7*a*, therefore, a current larger than usual flows to cause it to emit light with an intensity higher than usual. The light thus emitted from the LED 7*a* is not blocked by the mask plate 16*a* and made incident upon the resistor film 11. As a result, the resistor film 11 is exposed. Upon completion of exposure of the resistor film 11, the CPU 21 ends the identification processing.

Thus, when an unused sub-unit U2 enters an operative state, the resistor film 11 fitted thereto is exposed to have its conductivity decreased sufficiently. Therefore, if such a sub-unit U2 is once detached from the main unit U1 and then attached thereto again, the voltage value of the decision signal supplied to the main unit U1 is decreased below a value when an unused sub-unit U2 is attached.

That is, if the voltage value of the decision signal is lower than the threshold value, the attached sub-unit U2 is decided to be already used. When having confirmed at step ST2 that the voltage value of the decision signal is less than the threshold value, the CPU 21 executes error handling to cope with attachment of a wrong sub-unit U2 (step ST18). Then, the identification processing is terminated. Note here that the contents of the error handling at step ST18 may be arbitrary. The process performed at step ST27 may be, for example, notification of the attachment of a wrong sub-unit, to the user, inhibition of the image-forming process, or the like.

If having confirmed abnormal ending of the initial processing at step ST14, on the other hand, the CPU 21 executes error handling to cope with a failure of the initial processing (step ST19). The contents of the error handling may be arbitrary; for example, the user may be prompted to notify a maintenance person of that effect, may inhibit the execution of image formation, and may perform a similar process. In such a case, the CPU 21 skips steps 15 and 16, thus ending the identification processing. That is, a sub-unit U2 is not decided to have been used if it is once attached to the main unit U1 but the initial processing failed.

Thus, the second embodiment makes the identification secure even with a simple configuration as that of the first embodiment.

Furthermore, since the second embodiment employs the discharging lamp 7 as a light source for exposing the resistor film 11, no further light source needs to be provided, thus further simplifying the configuration. Moreover, the discharging lamp 7 can apply light to a larger area than the laser scanner 3, thus enhancing the degree of freedom of the position where the resistor film is disposed.

The LED 7*a* emits light in increased intensity to expose the resistor film 11 to light in the second embodiment. Namely, only one of the LEDs 7*a* to 7*e* emits intense light. This does not promote deterioration of the photosensitive drum 11.

Third Embodiment

Figure 9A:
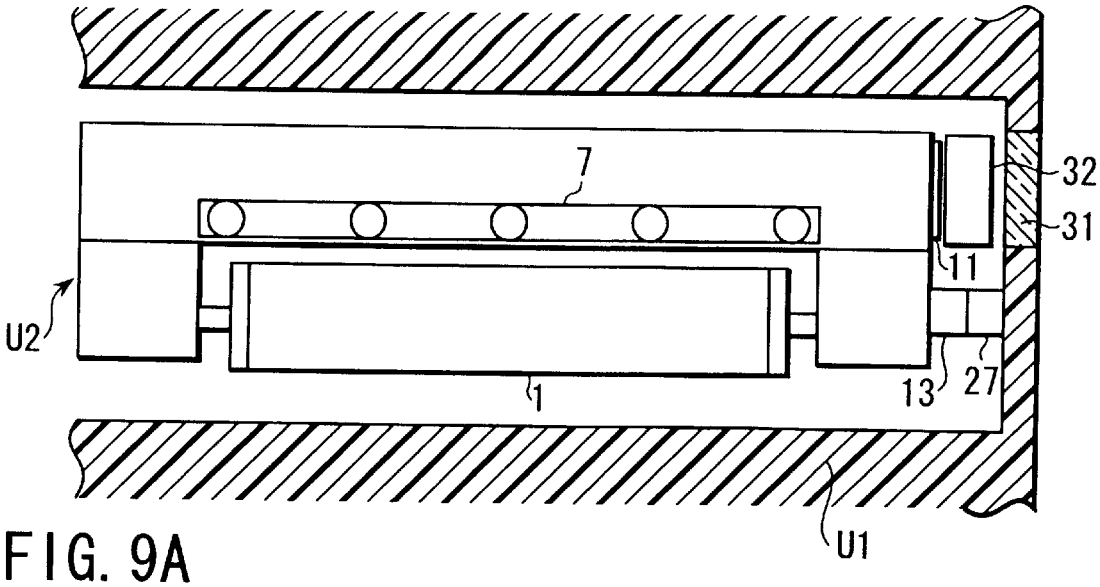
FIGS. 9A, 9B, and 9C are plan views for showing a construction for sub-unit identification in an electrophotographic apparatus of a third embodiment of the present invention.
Figure 9B:
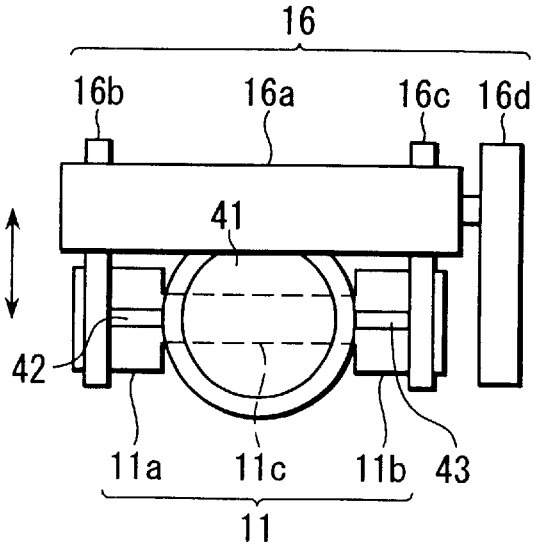
Figure 9C:
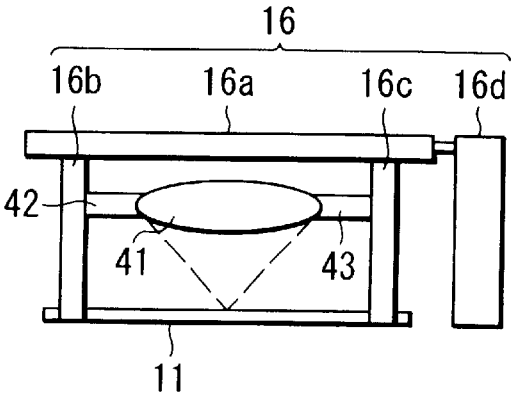

FIGS. 9A, 9B, and 9C are plan views for showing a construction for identifying the sub-unit U2 in an electrophotographic apparatus according to the third embodiment of the present invention. The basic configuration of the electrophotographic apparatus of the third embodiment is the same as that shown in FIG. 1. The same elements shown in these figures are indicated by the same reference numerals as those in the preceding figures and so their explanation is omitted here.

As shown in FIGS. 9A, 9B, and 9C, in the third embodiment, the resistor film 11 is disposed on a side surface of the sub-unit U2. In the frame of the main unit U1, opposing a position where the resistor film 11 is disposed with the sub-unit 2 attached is formed a transparent window 31 so that a natural light may be made incident therethrough upon the resistor film 11. The sub-unit U2 is also provided with an exposure unit 32 in such a manner that it may be disposed between the resistor film 11 and the window 31 when the sub-unit U2 is mounted on the main unit U1.

FIGS. 9B and 9C show a detailed construction of the exposure unit 32. FIG. 9B is a plan view for showing the exposure unit 32 as viewed from the right side in FIG. 9A. FIG. 9C is a plan view of the exposure unit 32 as viewed from the lower side in FIG. 9A.

As shown in FIGS. 9B and 9C, the exposure unit 32 has the mask mechanism 16 and a lens 41.

The positional relationship between the resistor film 11 and the mask mechanism 16 is the same as that of the first embodiment. The lens 41 is disposed between the resistor film 11 and the mask plate 16*a*. The lens 41 is adjusted to focus on the exposure region 11*c* of the resistor film 11. The lens 41 is fixed by support members 42 and 43 to the rails 16*b* and 16*c*.

Figure 10:
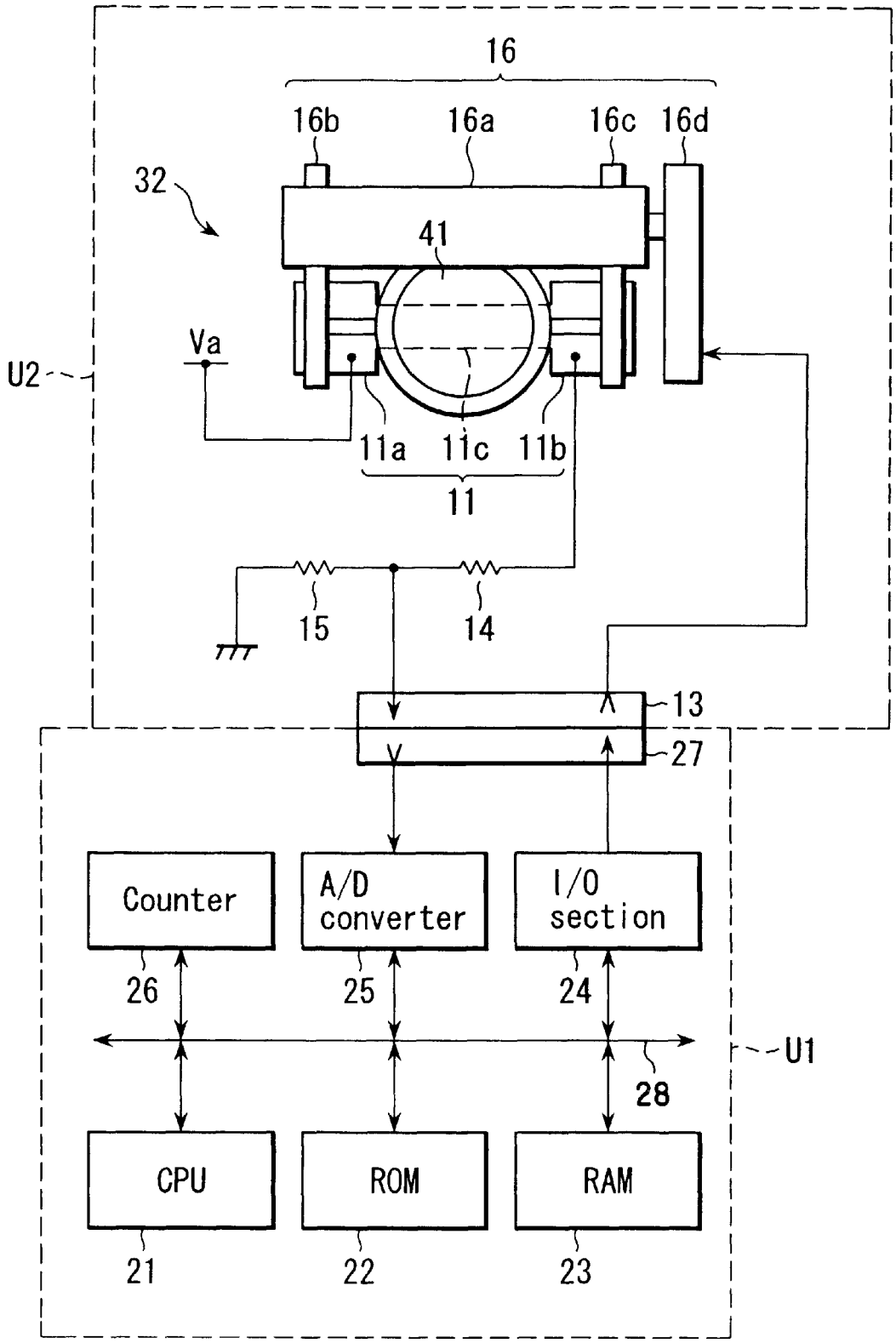
FIG. 10 is an illustration for showing a configuration of an electric circuit for sub-unit identification in the electrophotographic apparatus of the third embodiment of the present invention.

FIG. 10 is an illustration for showing a configuration of an electric circuit for identification of the sub-unit U2. The same elements in this figure are indicated by the same reference numerals as those in the preceding figures and so their detailed explanation is omitted here.

As shown in FIG. 10, the sub-unit U2 has the resistor film 11, the connector 13, the resistors 14 and 15, and the exposure unit 32. The main unit U1 has the CPU 21, the ROM 22, the RAM 23, the I/O section 24, the A/D converter 25, the counter 26, and the connector 27. The CPU 21, the ROM 22, the RAM 23, the I/O section 24, the A/D converter 25, and the counter 26 are connected via the bus 28.

An electric circuit on the side of the main unit U1 and an electric circuit on the side of the sub-unit U2 are interconnected by coupling the connectors 13 and 27 to.

The CPU 21 executes a software processing based on the operation programs stored in the ROM 22. The CPU 21 therefore functions not only as a control section of the known type for use in electro-photographic apparatuses, but also as an identification section and an exposure control section. The identification section determines whether the sub-unit U2 has not been used, from a voltage applied from the A/D converter 25. If the identification section determines that the sub-unit U2 has not been used, the exposure control section operates the mask mechanism 16 to expose the resistor film 11 to light when sub-unit U2 enters an operative state.

Next, the operations of the above-mentioned electrophotographic apparatus are described. The operations related to image formation, however, are the same as those with a prior art similar apparatus and so their explanation is omitted here. The following will detail those operations related to identification of the sub-unit U2.

The third embodiment is the same as the first embodiment in that the sub-unit U2 generates the decision signal having a voltage value which corresponds to whether the resistor film 11 is unexposed and then supplies it to the A/D converter 25.

Figure 11:
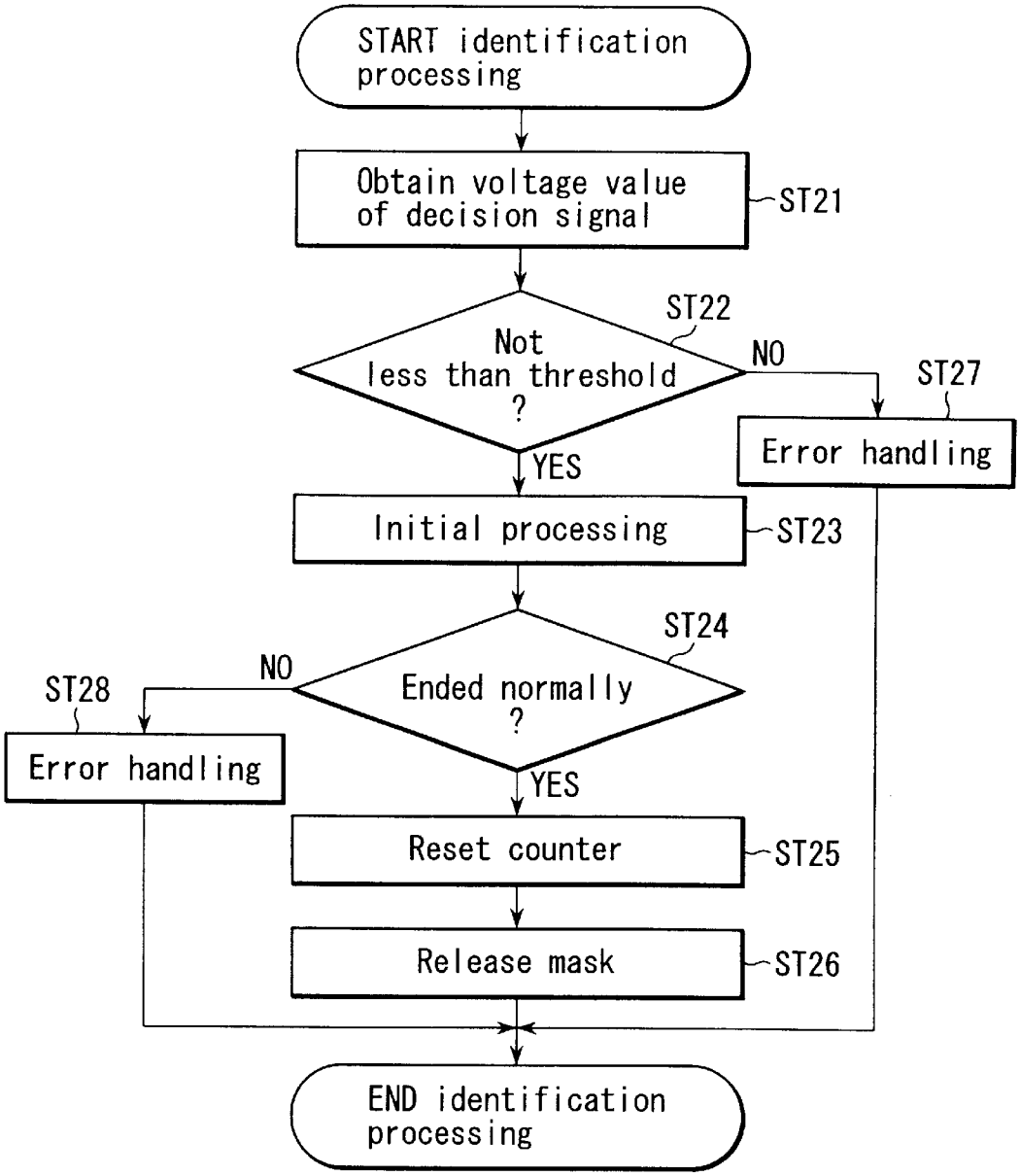
FIG. 11 is a flowchart for showing identification processing according to the third embodiment of the present invention.

When the sub-unit U2 changes in it state, from the one in which it is not attached to the main unit U1 to the sate in which it is attached thereto, the CPU 21 executes such an identification processing as is shown in FIG. 11.

In this identification processing, first the CPU 21 obtains a voltage value of the decision signal from the A/D converter 25 (step ST21) to then confirms whether the voltage value is not less than a predetermined threshold value (step ST22). This threshold value is beforehand set to an intermediate value between a voltage value of the decision signal when the resistor film 11 is unexposed and that of the decision signal when it is exposed.

If the voltage value of the decision signal is not less than the threshold value, the resistor film 11 of the sub-unit U2 as attached is decided to be in the unexposed state. That is, the attached sub-unit U2 is decided to be unused. When thus having confirmed a voltage value of the decision signal being not less than the threshold value at step ST22, the CPU 21 executes initial processing (step ST23). Incidentally, the initial processing is such a processing as testing the operations of the respective sections.

Upon completion of the initial processing, the CPU 21 confirms whether the initial processing ended normally (step ST24).

In this embodiment, normal ending of the initial processing is to mark start of use of the sub-unit U2. When thus having confirmed normal ending of the initial processing, the CPU 21 resets the counter 26 (step ST25). Then, the process starts monitoring the consumed quantity of the sub-unit U2 attached most recently.

Thus, normal ending of the initial processing is supposed to mark the start of using the sub-unit U2, so that it is necessary to prevent the resistor film 11 from being exposed until the normal ending. To do so, when a sub-unit U2 is shipped, the mask mechanism 16 is set thereon with its mask plate 16*a* located above the resistor film 11. That is, in the initial state, the mask mechanism 16 is in such a state that the mask plate 16*a* is slid downward in FIG. 10 to be superposed on the resistor film 11. Before the initial processing is executed and when the initial processing is being executed, therefore, natural light passing through the window 31 is blocked by the mask plate 16*a* and so little of it reaches the resistor film 11. When the sub-unit U2 is being attached to the main unit U1 also, the natural light is blocked by the mask plate 16*a* and little of it reaches the resistor film 11. Thus, the resistor film 11 is prevented from being exposed before the initial processing ends.

Next, the CPU 21 drives the motor 16*d* to change the mask plate 16*a* into such a state as shown in FIG. 10 (step ST26). Then, the natural light passing through the window 31 is not blocked by the mask plate 16*a* and made incident upon the lens 41. The natural light is then converged by the lens 41 to be applied to the exposure region 11*c* of the resistor film 11. As a result, the resistor film 11 is exposed. Upon completion of the exposure of the resistor film 11, the CPU 21 ends the identification processing.

Thus, when an unused sub-unit U2 enters an operative state, the resistor film 11 fitted thereto is exposed to have its conductivity decreased sufficiently. Therefore, if such a sub-unit U2 is once detached from the main unit U1 and then attached thereto again, the voltage value of decision signal supplied to the main unit U1 is decreased below a value when an unused sub-unit U2 is attached.

That is, if the voltage value of the decision signal is lower than the threshold value, the attached sub-unit U2 is decided to be already used. When having confirmed at step ST22 that the voltage value of the decision signal is less than the threshold value, the CPU 21 executes error handling to cope with attachment of a wrong sub-unit U2 (step ST27). Then, the identification processing is terminated. Note here that the contents of the error handling at step ST27 may be arbitrary. The process performed at step ST27 may be, for example, notification of the attachment of a wrong sub-unit, to the user, inhibition of the image-forming process, or the like.

If having confirmed a normal ending of the initial processing at step ST24, on the other hand, the CPU 21 executes error handling to cope with a failure of the initial processing (step ST28). The contents of the error handling may be arbitrary; for example, the user may be prompted to notify a maintenance person of that effect, may inhibit the execution of image formation, and may perform a similar process. In such a case, the CPU 21 skips steps 25 and 26, thus ending the identification processing. That is, a sub-unit U2 is not decided to have been used if it is once attached to the main unit U1 but the initial processing failed.

Thus, the third embodiment can makes identification secure even with a simple configuration as to that of the first embodiment.

Since the third embodiment employs natural light as a light source for exposing the resistor film 11, no further light source needs to be provided, thus further simplifying the configuration.

Figure 12:
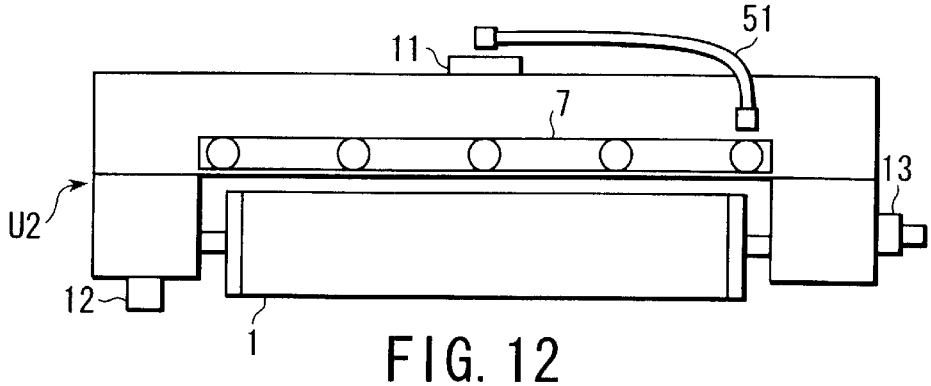
FIG. 12 is a plan view for showing a variant of the construction for sub-unit identification in the electrophotographic apparatus of the second embodiment of the present invention.

In the above-mentioned respective embodiments, a laser beam emitted from the laser scanner 3, a light emitted from the LED 7*a*, or natural light is adapted to be made incident upon the resistor film 11 without changing the optical path. If such a layout is difficult to realize, however, the beam or the light may be guided to the resistor film 11 as changing the optical path by using a light transmitting element such as an optical fiber or an optical element such as a mirror. FIG. 12 shows a specific example. FIG. 12 is an illustration for showing a variant of the second embodiment. In it, a light emitted from the LED 7*a* is guided through an optical fiber 51 to the resistor film 11.

A dedicated light source may be provided for exposing the resistor film 11.

In the above-mentioned embodiments, when the initial processing ended normally, the resistor film 11 is exposed. The resistor film 11 may be exposed at an earlier time. Alternatively, the resistor film 11 may be exposed at a later time, for example, after print-out is carried out for the first time. That is, the sub-unit U2 may be started in use at an arbitrary time. Thus, it suffices to apply light to the resistor film 11 at any time the sub-unit U2 is started in use.

To expose the resistor film 11 to light earlier in the second embodiment, the discharging lamp 7 should possibly be lighted for that purpose or done so in the initial processing. In either case, the resistor film 11 is exposed when the discharging lamp 7 is lighted initially, thus enabling omitting the mask mechanism 16 and the processing for controlling it.

The above-mentioned embodiments have provided the sub-unit U2 with the resistors 14 and 15 and also the main unit U1 with the analog-to-digital converter 25 respectively. The resistors 14 and 15, however, may be provided on the main unit U1. Conversely, the analog-to-digital converter 25 may be provided on the sub-unit U2.

Although the above-mentioned embodiments have employed such a resistor film 11 that is formed by applying a material changing in conductivity when exposed, the present invention may employ an arbitrary form of and manner of providing the resistor changing in conductivity when exposed; for example, such a film-shaped resistor may be affixed that is made of a material changing in conductivity when exposed, or such a resistor element may be fitted that is made of a material changing in conductivity when exposed.

The first embodiment has provided the laser scanner 3 on the main unit U1. The laser scanner 3, however, may be provided on the sub-unit U2.

In the first and second embodiments, the laser scanner 3 or the discharging lamp 7 is made higher in light-emission intensity than usual in order to expose the resistor film 11. Such processing, however, can be omitted by making the resistor film 11 of such a material that can be exposed with an ordinary light-emission intensity. In the third embodiment also, the lens 41 can be omitted by making the resistor film 11 of such a material that can be exposed with natural light.

In the first embodiment, the exposure of the resistor film 11 is controlled by turning ON/OFF a laser beam to be emitted at the position of the resistor film 11. The mask mechanism 16, however, may be provided to control the exposure of the resistor film 11 while always emitting a laser beam at the position of the resistor film 11.

The second embodiment has employed the mask mechanism 16 in order to prevent the resistor film 11 from being exposed by a light emitted from the discharging lamp 7 in the initial processing. The mask mechanism 16, however, can be omitted by making the resistor film 11 of such a material that is not exposed with an intensity of a discharging light emitted from the discharging lamp 7.

The second embodiment has provided the discharging lamp 7 on the sub-unit U2. The discharging lamp 7, however, may be provided on the main unit U1.

In the third embodiment, the lens 41 may be provided on the main unit U1. Moreover, it is possible to provide both the mask mechanism 16 and the lens 41 on the main unit U1 by making the resistor film 11 of such a material that is not exposed by natural light not passing through the lens 41.

In the third embodiment, natural light is converged by the lens 41 to be enhanced in intensity and then exposes the resistor film 11. The lens 41, however, can be omitted by making the resistor film 11 of a material that is exposed by natural light.

In the third embodiment, the exposure of the resistor film 11 is controlled by the mask mechanism 16. The mask mechanism 16, however, can be omitted by providing, for example, a mechanism for deflecting the optical axis or the focus of the lens 41 so that the quantity of a light applied to the resistor film 11 can be changed through the lens 41.

In the above-mentioned embodiments, the mask mechanism 16 is provided with the motor 16*d* for moving the mask plate 16*a*. The mask plate 16*a* can be moved under the control of, for example, a clutch as driven by any other motor. Additionally, in the third embodiment, if the resistor film 11 is exposed immediately after the sub-unit U2 is mounted, the mask plate 16*a* can be moved mechanically by utilizing the insertion of the sub-unit U2.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An electrophotographic apparatus, having a main unit and a sub-unit which is attachable, in such a way that it may be detached, to said main unit arbitrarily, for using said sub-unit in said main unit to thereby form an image, comprising:

a resistive element which is fitted to said sub-unit and which is made of such a material that is changed in conductivity when exposed;

an exposure section configured to expose said resistive element when said sub-unit attached to said main unit enters a predetermined operative state;

a detection section configured to detect a conductivity of said resistive element fitted to said sub-unit attached to said main unit; and an identification section, provided on said main unit, configured to decide whether, as the attachment of said sub-unit is made, said attached sub-unit is unused on the basis of the conductivity detected by said detection section.

2. An electrophotographic apparatus according to claim 1, including an exposing device configured to carry out an exposure process of electrophotographic processes, wherein:

said resistive element is disposed so as to be located in an image non-forming region within a scanning range of said exposing device in such a state that said sub-unit is attached to said main unit; and said exposure section comprises said exposing device and an exposure control section configured to light said exposing device in order to expose said resistive element.

3. An electrophotographic apparatus according to claim 2, wherein said exposure control section lights said exposing device in order to expose said resistive element at a predetermined timing after said identification section decides that said sub-unit is unused.

4. An electrophotographic apparatus according to claim 3, wherein said exposure control section makes higher a light-emission intensity of said exposing device than a light-emission intensity for image formation, when lighting said exposing device to expose said resistive element.

5. An electrophotographic apparatus according to claim 2, wherein said exposing device is a laser scanner.

6. An electrophotographic apparatus according to claim 1, including a discharging lamp configured to carry out a discharging process of electrophotographic processes, wherein:

said resistive element is located at a position where a light emitted from said discharging lamp reaches in such a state that said sub-unit is attached to said main unit; and said discharging lamp is used as said exposure section.

7. An electrophotographic apparatus according to claim 6, wherein said exposure section further comprises:

a mask section configured to open/close an optical path from said discharging lamp to said resistive element; and an exposure control section configured to cause said mask section to open said optical path in order to expose said resistive element at a predetermined timing after said identification section decides that said sub-unit is unused.

8. An electrophotographic apparatus according to claim 6, wherein said exposure section further comprises:

a light converging section configured to converge light emitted from said discharging lamp and then guiding said light to said resistive element.

9. An electrophotographic apparatus according to claim 1, wherein said exposure section comprises:

a mask section configured to open/close an optical path for making natural light incident upon said resistive element; and an exposure control section configured to cause said mask section to open said optical path in order to expose said resistive element at a predetermined timing after said identification section decides that said sub-unit is unused.

10. An electrophotographic apparatus according to claim 9, wherein said exposure section further comprises a light converging section configured to converge natural light and then making said light incident upon said resistive element.

11. An electrophotographic apparatus according to claim 1, wherein said exposure section includes a light transmission section configured to transmit a light emitted from a predetermined light source and making said light incident upon said resistive element.

12. A main unit which, when a sub-unit fitted with a resistive element made of such a material that is changed in conductivity when exposed is arbitrarily attached thereto, constitutes an electrophotographic apparatus together with said sub-unit, comprising:

a detection section configured to detect a conductivity of said resistive element fitted to said sub-unit attached; and an identification section configured to decide whether, as the attachment of said sub-unit is made, said attached sub-unit is unused on the basis of a conductivity detected by said detection section.

13. A sub-unit which is arbitrarily attached to a main unit and which constitutes an electrophotographic apparatus together with said main unit in order to enable image formation by said main unit, said sub-unit including a resistive element made of a material which is changed in conductivity when exposed.

14. An identification method for performing the identification of a sub-unit fitted with a resistive element made of a material which is changed in conductivity when exposed, by a main unit which forms an image by utilizing said sub-unit and also which constitutes an electrophotographic apparatus together with said sub-unit when said sub-unit is arbitrarily attached thereto, said method comprising:

detecting a conductivity of said resistive element fitted to said sub-unit attached; and deciding, as the attachment of said sub-unit is made, whether said attached sub-unit is unused on the basis of said detected conductivity.

* * * * *